US010128596B2

(12) United States Patent
Tsai et al.

(10) Patent No.: US 10,128,596 B2
(45) Date of Patent: Nov. 13, 2018

(54) ELECTRICAL RECEPTACLE CONNECTOR

(71) Applicant: ADVANCED-CONNECTEK INC., New Taipei (TW)

(72) Inventors: Yu-Lun Tsai, New Taipei (TW); Pin-Yuan Hou, New Taipei (TW); Chung-Fu Liao, New Taipei (TW); Long-Fei Chen, New Taipei (TW); Hung-Yu Chen, New Taipei (TW); Hsu-Fen Wang, New Taipei (TW)

(73) Assignee: Advanced-Connectek Inc., New Taipei (TW)

( * ) Notice: Subject to any disclaimer, the term of this patent is extended or adjusted under 35 U.S.C. 154(b) by 2 days.

(21) Appl. No.: 15/484,398

(22) Filed: Apr. 11, 2017

(65) Prior Publication Data

US 2017/0294726 A1 Oct. 12, 2017

(30) Foreign Application Priority Data

Apr. 11, 2016 (CN) ..... 2016 1 0219690

(51) Int. Cl.

| | |
|---|---|
| ***H01R 12/71*** | (2011.01) |
| ***H01R 13/516*** | (2006.01) |
| ***H01R 13/6581*** | (2011.01) |
| ***H01R 24/64*** | (2011.01) |
| ***H01R 12/72*** | (2011.01) |
| ***H01R 24/60*** | (2011.01) |
| *H01R 107/00* | (2006.01) |

(52) U.S. Cl.

CPC ..... *H01R 12/716* (2013.01); *H01R 12/724* (2013.01); *H01R 13/516* (2013.01); *H01R 13/6581* (2013.01); *H01R 24/60* (2013.01); *H01R 24/64* (2013.01); *H01R 2107/00* (2013.01)

(58) Field of Classification Search

CPC ..... H01R 12/716; H01R 13/6593

USPC .... 439/607.55, 660, 607.35, 607.01, 607.38, 439/607.27

See application file for complete search history.

(56) References Cited

U.S. PATENT DOCUMENTS 5,221,212 A * 6/1993 Davis ..... H01R 23/6873 439/108
5,254,010 A * 10/1993 Davis ..... H01R 13/658 439/108
5,984,725 A * 11/1999 Belopolsky ..... H01R 13/7195 439/607.31
6,083,043 A * 7/2000 Lok ..... H01R 12/7064 439/567
6,280,209 B1 * 8/2001 Bassler ..... H01R 12/724 439/101
6,347,961 B2 * 2/2002 Zhu ..... H01R 13/65802 439/541.5
6,454,603 B2 * 9/2002 Casey ..... H01R 13/6272 439/607.28

(Continued)

*Primary Examiner* — Tulsidas C Patel
*Assistant Examiner* — Peter G Leigh
(74) *Attorney, Agent, or Firm* — Muncy, Geissler, Olds & Lowe, P.C.

(57) ABSTRACT

An electrical receptacle connector includes a metallic shell and a terminal module in the metallic shell. One or more first leg extends outwardly from two sides of the metallic shell. A first slot is formed on the first leg. When the electrical receptacle connector is soldered to a circuit board, the first slot increases the space for receiving the solders to prevent solder wicking.

15 Claims, 11 Drawing Sheets

(56) References Cited

U.S. PATENT DOCUMENTS 6,475,033 B1 * 11/2002 Zhu ..... H01R 13/658 439/607.4
6,682,368 B2 * 1/2004 Murr ..... H01R 13/6582 439/607.28
6,863,569 B2 * 3/2005 Zhu ..... H01R 13/65802 439/607.23
7,211,739 B1 * 5/2007 Brigham, Jr. ..... H05K 9/0058 174/359
8,257,114 B2 * 9/2012 Wang ..... H01R 12/57 439/607.01
8,262,414 B1 * 9/2012 Li ..... H01R 13/6273 439/607.35
8,323,057 B2 * 12/2012 Ho ..... H01R 12/725 439/607.4
8,360,808 B2 * 1/2013 Tsuchiya ..... H01R 12/724 439/607.27
8,435,075 B2 * 5/2013 Lim ..... H01R 12/7047 439/607.35
8,535,097 B2 * 9/2013 Yen ..... H01R 13/6594 439/607.27
8,568,172 B1 * 10/2013 Lan ..... H01R 12/57 439/607.4
8,740,649 B2 * 6/2014 Lan ..... H01R 13/506 439/607.4
8,882,540 B2 * 11/2014 Yen ..... H01R 27/00 439/489
8,936,492 B2 * 1/2015 Ho ..... H01R 12/724 439/660
8,968,031 B2 * 3/2015 Simmel ..... H01R 13/659 439/108
9,293,869 B2 * 3/2016 Ning ..... H01R 13/6594
9,620,904 B2 * 4/2017 Kao ..... H01R 13/6581
2011/0159733 A1 * 6/2011 Wang ..... H01R 12/57 439/607.01
2014/0030920 A1 * 1/2014 Lan ..... H01R 13/506 439/607.01
2015/0118887 A1 * 4/2015 Katayanagi ..... H01R 13/6582 439/353
2015/0194770 A1 * 7/2015 Little ..... H01R 13/6582 439/607.27
2015/0244111 A1 * 8/2015 Ju ..... H01R 13/6585 439/607.05
2015/0255905 A1 * 9/2015 Little ..... H01R 13/6658 439/78
2015/0270646 A1 * 9/2015 Kao ..... H01R 13/6581 439/76.1

* cited by examiner

ELECTRICAL RECEPTACLE CONNECTOR

CROSS-REFERENCE TO RELATED APPLICATION

This non-provisional application claims priority under 35 U.S.C. § 119(a) to Patent Application No. 201610219690.9 filed in China, P.R.C. on Apr. 11, 2016, the entire contents of which are hereby incorporated by reference.

FIELD OF THE INVENTION

The instant disclosure relates to an electrical connector, and more particular to an electrical receptacle connector.

BACKGROUND

Generally, Universal Serial Bus (USB) is a serial bus standard to the PC architecture with a focus on computer interface, consumer and productivity applications. The existing Universal Serial Bus (USB) interconnects have the attributes of plug-and-play and ease of use by end users. Now, as technology innovation marches forward, new kinds of devices, media formats and large inexpensive storage are converging. They require significantly more bus bandwidth to maintain the interactive experience that users have come to expect. In addition, the demand of a higher performance between the PC and the sophisticated peripheral is increasing. The transmission rate of USB 2.0 is insufficient. As a consequence, faster serial bus interfaces such as USB 3.0, are developed, which may provide a higher transmission rate so as to satisfy the need of a variety devices.

The appearance, the structure, the contact ways of terminals, the number of terminals, the pitches between terminals (the distances between the terminals), and the pin assignment of terminals of a conventional USB type-C electrical connector are very different from those of a conventional USB electrical connector. A conventional USB type-C electrical receptacle connector includes a plastic core, upper and lower receptacle terminals held on the plastic core, and an outer iron shell circularly enclosing the plastic core. The plastic core of the conventional connector is an assembly of several plastic pieces, and the upper and lower receptacle terminals are respectively combined with the plastic pieces.

SUMMARY OF THE INVENTION

However, in the conventional, upon the legs of the outer iron shell is inserted into the holes of the circuit board for soldering, solders may flow out of the hole from gaps between the hole and the leg due to insufficient spaces for receiving the solders. As a result, solder wicking occurs, and the solders would flow to the surface of the circuit board and contact contacts on the circuit board to lead short circuit problems. Therefore, how to solve the aforementioned problem is an issue.

In view of this, an embodiment of the instant disclosure provides an electrical receptacle connector. The electrical receptacle connector comprises a terminal module and a metallic shell. The terminal module comprises a base portion, a tongue portion extended outwardly from one end of the base portion, and a plurality of receptacle terminals. The receptacle terminals are held in the base portion. One of two ends of each of the receptacle terminals extends toward the tongue portion, and the other end of each of the receptacle terminals protrudes out of the base portion. The metallic shell receives the terminal module. Each of two sides of the metallic shell extends outwardly at least one first leg from, and each of the first legs forms a first slot.

In one embodiment, the metallic shell comprises two side plates, a top plate, and a bottom plate. The two side plates respectively locate adjacent to two sides of the tongue portion. The top plate locates adjacent to a first surface of the tongue portion. The bottom plate locates adjacent to a second surface of the tongue portion opposite to the first surface. The two side plates, the top plate, and the bottom plate are connected with each other to form an insertion opening of the metallic shell, and the insertion opening is near a front end of the tongue portion.

In one embodiment, the electrical receptacle connector further comprises an outer shell. The outer shell is out of the metallic shell and near the insertion opening, wherein the outer shell stacks on the metallic shell to form a double-layer shell structure.

In one embodiment, the metallic shell comprises a front region and a rear region defined at the bottom plate and located at a rear portion of the front region.

In one embodiment, the outer shell comprises a plurality of sidewalls and a plurality of second legs, the sidewalls respectively extend toward two sides of the rear region, and the second legs respectively extend outwardly from edges of the sidewalls.

In one embodiment, one of the second legs on each of the sidewalls is near an outer side of the corresponding first leg and aligned with the corresponding first leg.

In one embodiment, each of the second legs comprises a second main body and a second slot formed on the second main body.

In one embodiment, each of the second legs comprises a plurality of second recessed portions, and the second recessed portions are formed at two sides of the second main body.

In one embodiment, the second legs at front portions of the sidewalls are aligned along a horizontal line, and the second legs at rear portions of the sidewalls are aligned along a horizontal line and near the two sides of the base portion.

In one embodiment, the receptacle terminals comprise a plurality of first receptacle terminals and a plurality of second receptacle terminals. The first receptacle terminals and the second receptacle terminals are held in the base portion and the tongue portion. First flat contact portions of the first receptacle terminals at one ends of the first receptacle terminals are at the first surface of the tongue portion, and second flat contact portions of the second receptacle terminals at one ends of the second receptacle terminals are at the second surface of the tongue portion.

In one embodiment, the electrical receptacle connector further comprises a shielding plate held inside the base portion and the tongue portion. The shielding plate comprises a plate body and a plurality of shielding legs. The plate body is between the first flat contact portions and the second flat contact portions. The shielding legs extend outwardly from two sides of the plate body. Each of the shielding legs is near an inner side of the corresponding first leg and aligned with the corresponding first leg.

In one embodiment, each of the first legs comprises a first main body and a plurality of first recessed portions, and the first recessed portions are formed at two sides of the first main body.

In one embodiment, the outer shell comprises a top portion, a bottom portion, and two side portions each connected to the top portion and the bottom portion. The top portion, the bottom portion, and the two side portions form a receiving space for receiving the metallic shell.

In one embodiment, the outer shell comprises a top portion and two side portions respectively extended from two sides of the top portion. The top portion and the two side portions form an assembling space for stacking on the metallic shell.

In one embodiment, the base portion comprises a plurality of positioning posts, and each of the positioning posts is near the corresponding first leg.

In one embodiment, a rear cover and a plurality of first legs extend from a rear portion of the metallic shell, and the first legs extend outwardly from two sides of the rear cover.

As above, the first slot is formed on each of the first legs on the corresponding side of the metallic shell, and the first slot increases the space for receiving the solders to prevent solder wicking. Moreover, the outer shell is out of the metallic shell and near the insertion opening, and the outer shell stacks on the metallic shell. Therefore, the electrical receptacle connector can have a double-layer shell structure formed by the metallic shell and the outer shell. Accordingly, the structural strength of the metallic shell around the insertion opening can be improved. Hence, when an electrical plug connector is inserted into the insertion opening of the metallic shell, the metallic shell does not deform or bend easily. Moreover, one shielding leg, one first leg, and one second leg are inserted into the same hole of the circuit board. Thus, the fixation between the connector and the circuit board can be improved and the cost for fabricating the holes of the circuit board can be reduced. Furthermore, the first slot and the first recessed portions of the first leg allow the first leg to have more spaces to receive the solder to prevent solder wicking. Similarly, the second slot and the second recessed portions of the second leg allow the second leg to have more spaces to receive the solder to prevent solder wicking.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

Detailed description of the characteristics and the advantages of the instant disclosure are shown in the following embodiments. The technical content and the implementation of the instant disclosure should be readily apparent to any person skilled in the art from the detailed description, and the purposes and the advantages of the instant disclosure should be readily understood by any person skilled in the art with reference to content, claims, and drawings in the instant disclosure.

BRIEF DESCRIPTION OF THE DRAWINGS

The instant disclosure will become more fully understood from the detailed description given herein below for illustration only, and thus not limitative of the instant disclosure, wherein.

DETAILED DESCRIPTION

Figure 1:
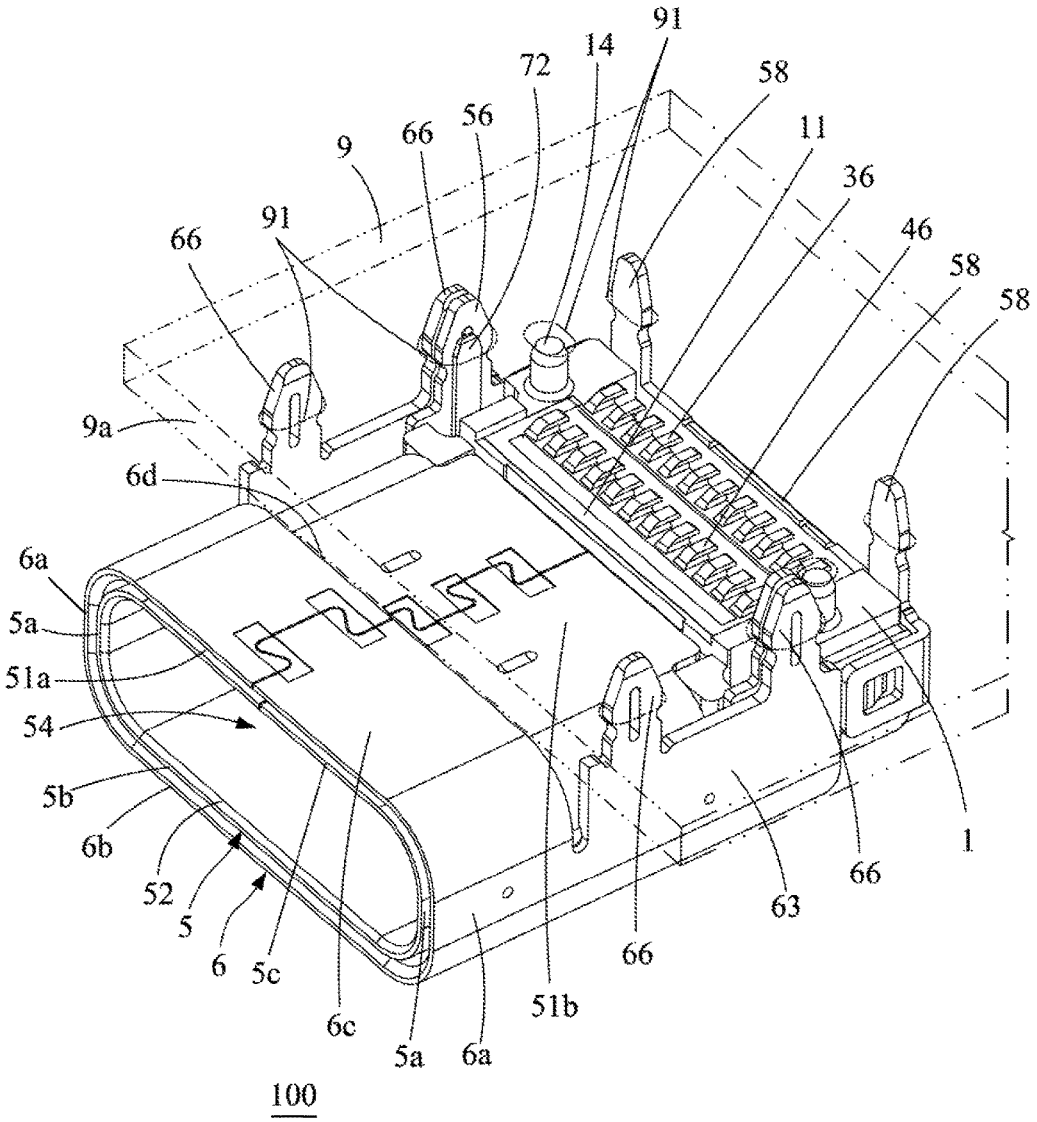
FIG. 1 illustrates a perspective view of an electrical receptacle connector mounted onto a circuit board, according to an exemplary embodiment of the instant disclosure.
Figure 2:
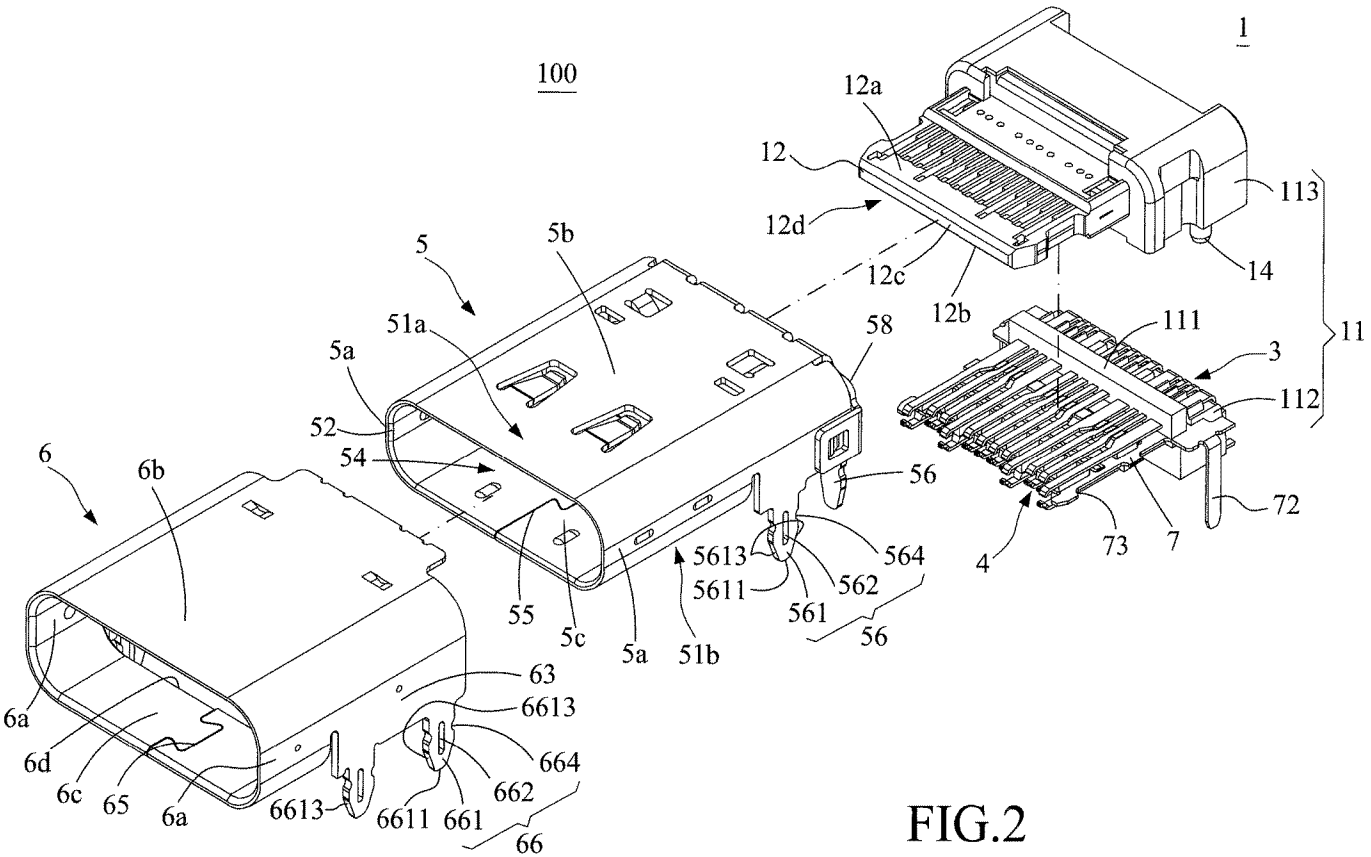
FIG. 2 illustrates an exploded view of the electrical receptacle connector.
Figure 3:
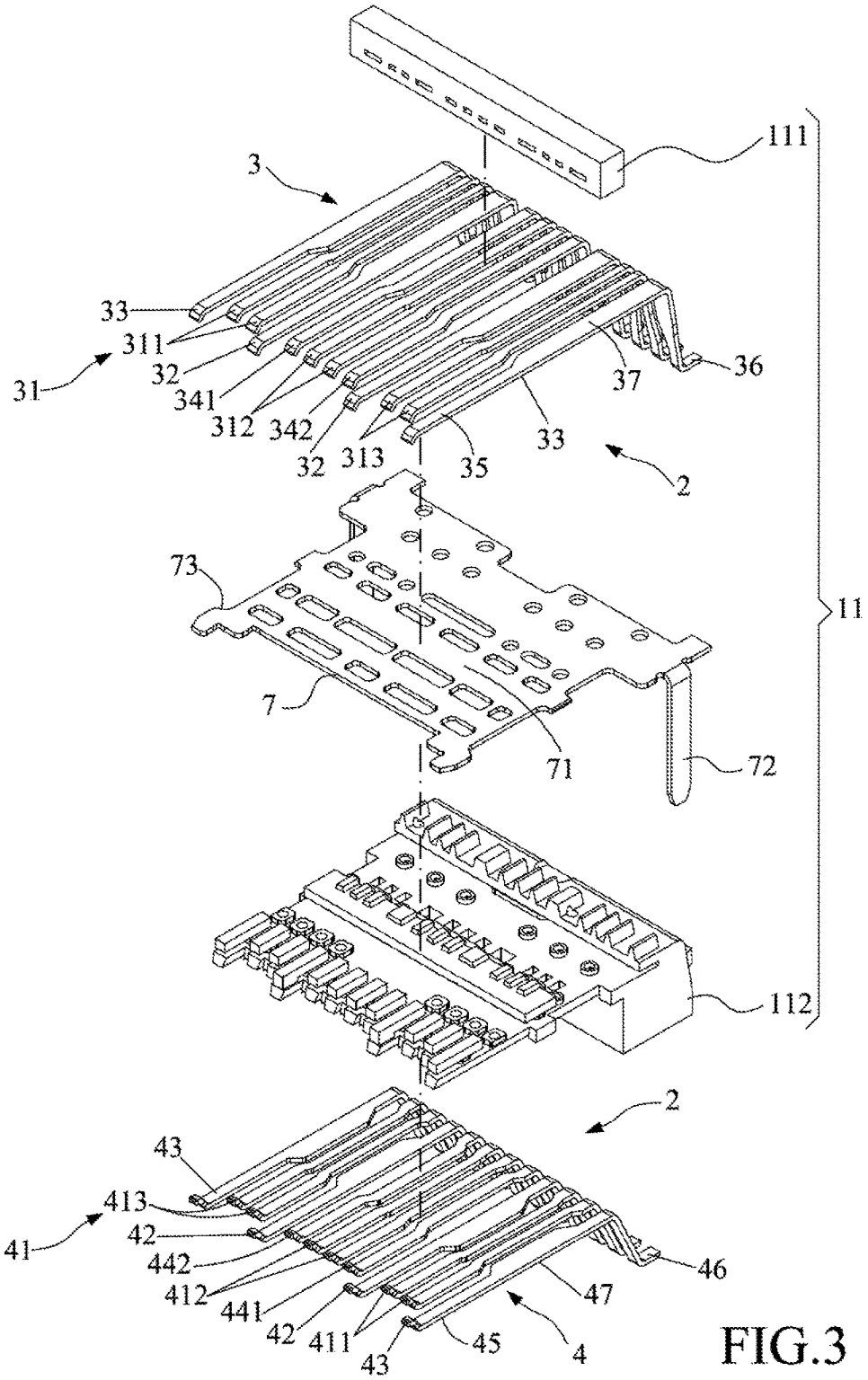
FIG. 3 illustrates an exploded view of a terminal module of the electrical receptacle connector.
Figure 4:
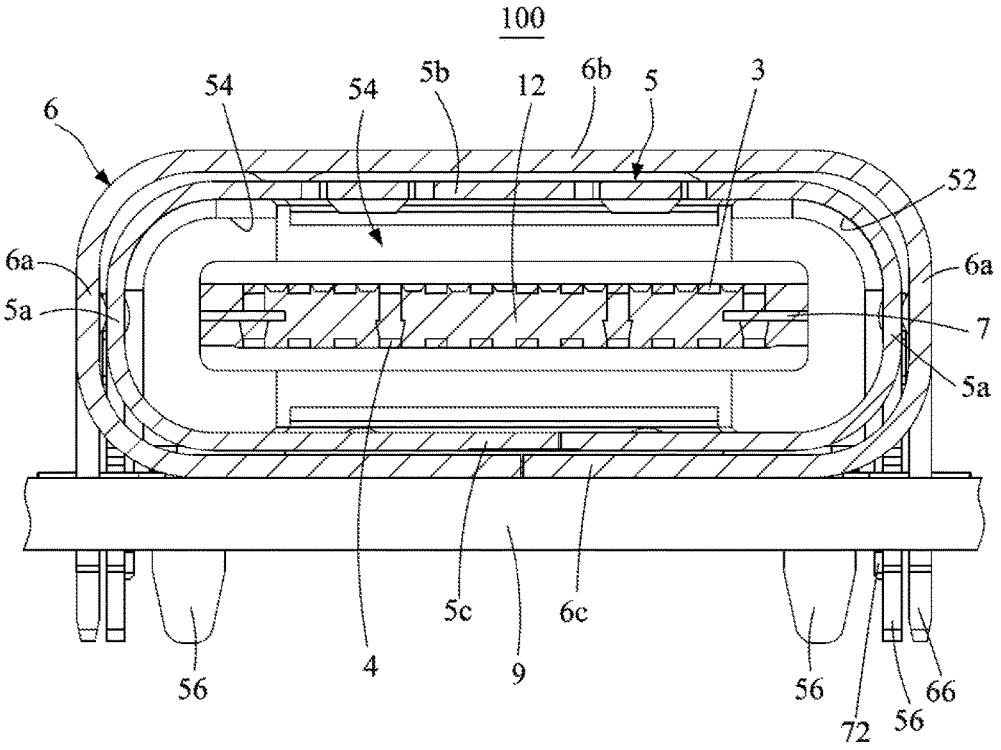
FIG. 4 illustrates a front sectional view of the electrical receptacle connector.
Figure 11:
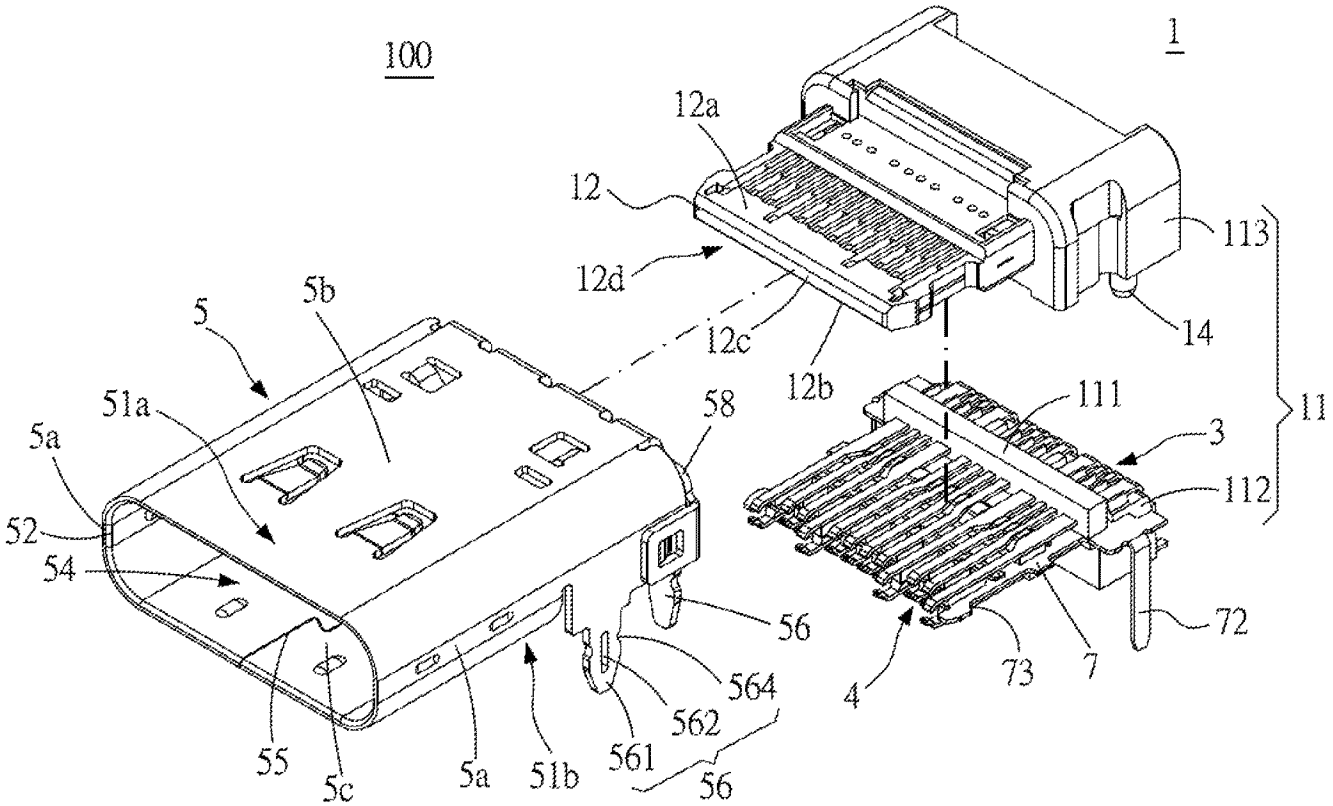
FIG. 11 illustrates an exploded view of one embodiment of the connector showing that the connector comprises a single shell.

Please refer to FIGS. 1 to 4, illustrating an electrical receptacle connector of an exemplary embodiment of the instant disclosure. FIG. 1 illustrates a perspective view of the electrical receptacle connector mounted onto a circuit board. FIG. 2 illustrates an exploded view of the electrical receptacle connector. FIG. 3 illustrates an exploded view of a terminal module of the electrical receptacle connector. FIG. 4 illustrates a front sectional view of the electrical receptacle connector. In this embodiment, the electrical receptacle connector 100 can provide a reversible or dual orientation USB Type-C connector interface and pin assignments, i.e., a USB Type-C receptacle connector. In this embodiment, the number of the receptacle terminals of the electrical receptacle connector 100 is suitable for USB 3.0 signal transmission, but embodiments are not limited thereto. In one embodiment, the number of the receptacle terminals of the electrical receptacle connector 100 is suitable for USB 2.0 signal transmission, and in this case, the electrical receptacle connector 100 may be devoid of a shielding plate 7. In this embodiment, the electrical receptacle connector 100 comprises a terminal module 1, a metallic shell 5, and an outer shell 6, but embodiments not limited thereto. In one embodiment, as shown in FIG. 11, the electrical receptacle connector 100 is devoid of the outer shell and only has the metallic shell 5.

Please refer to FIGS. 2 and 3. In this embodiment, the terminal module 1 comprises a base portion 11, a tongue portion 12, and a plurality of receptacle terminals 2. The tongue portion 12 outwardly extends from one end of the base portion 11. The receptacle terminals 2 are held in the base portion 11. In this embodiment, one of two ends of each of the receptacle terminals 2 extends toward the tongue portion 12. In addition, the other end of each of the receptacle terminals 2 protrudes out of the base portion 11. The receptacle terminals 2 on the base portion 11 are arranged in two rows.

Please refer to FIGS. 2 and 3. In this embodiment, the base portion 11 comprises a plurality of positioning posts 14. The positioning posts 14 are at two sides of a bottom of the base portion 11 and each of the positioning posts 14 is near the corresponding first leg 56 of the metallic shell 5. After the positioning posts 14 are inserted into holes 91 of the circuit board 9, the fixation of electrical receptacle connector 100 on the circuit board 9 can be improved.

Please refer to FIGS. 2 to 4. In this embodiment, the tongue portion 12 has two opposite surfaces, one is a first surface 12*a*, and the other is a second surface 12*b*. In addition, a front lateral surface 12*c* of the tongue portion 12 is connected the first surface 12*a* with the second surface 12*b* and is close to an insertion opening 52 of the metallic shell 5. In other words, the front lateral surface 12*c* is near the insertion opening 52 and perpendicularly connected to the first surface 12*a* and the second surface 12*b*, respectively. A front end 12*d* of the tongue portion 12 is at the front lateral surface 12*c*, so that an electrical plug connector is aligned with the insertion opening 52 and inserted into the metallic shell 5 via the front end 12*d* of the tongue portion 12.

Please refer to FIGS. 2 and 3. In this embodiment, the tongue portion 12 and the base portion 11 are formed integrally, and the tongue portion 12 is at one end of the base portion 11. In other words, the tongue portion 12 and the base portion 11 is the assembly of a first terminal base 111, a second terminal base 112, and a third terminal base 113. First receptacle terminals 3 are held in the first terminal base 111. Second receptacle terminals 4 and a shielding plate 7 are held inside the second terminal base 113. After the first terminal base 111 and the second terminal base 112 are assembled with each other, the third terminal base 113 encloses the assembly of the first terminal base 111 and the second terminal base 112, but embodiments are not limited thereto. In some embodiments, the first terminal base 111, the second terminal base 112, and the third terminal base 113 may be a unitary member (or two separated members). Specifically, in this embodiment, when the number of the receptacle terminals 2 of the electrical receptacle connector 100 is suitable for USB 3.0 signal transmission, the electrical receptacle connector 100 further comprises a shielding plate 7 for shielding.

Please refer to FIGS. 2 to 4. In this embodiment, the receptacle terminals 2 comprise first receptacle terminals 3 and second receptacle terminals 4, and the first receptacle terminals 3 and the second receptacle terminals 4 are respectively formed as upper-row terminals and lower-row terminals. Therefore, the receptacle terminals 3 are arranged in two rows, but embodiments are not limited thereto. In one embodiment, the receptacle terminals 2 are arranged in one row, and the receptacle terminals 2 may be the first receptacle terminals 3 or the second receptacle terminals 4.

Please refer to FIGS. 2 to 4. In this embodiment, the first receptacle terminals 3 are assembled on the first terminal base 111. Two ends of each of the first receptacle terminals 3 respectively comprise a flat contact portion 35 and a tail portion 36. In other words, the tail portion 36 extends from one end of the flat contact portion 35. The flat contact portions 35 are positioned in terminal grooves on one of the two surfaces (i.e., the first surface 12*a* or the second surface 12*b*) of the tongue portion 12. The tail portions 36 protrude out of the base portion 11.

Please refer to FIGS. 2 to 4. In this embodiment, the second receptacle terminals 4 and the shielding plate 7 are assembled on the second terminal base 112. Two ends of each of the second receptacle terminals 4 respectively comprise a flat contact portion 45 and a tail portion 46. In other words, the tail portion 46 extends from one end of the flat contact portion 45. The tail portions 46 protrude out of the base portion 11.

Please refer to FIGS. 2 to 4. In this embodiment, the first receptacle terminals 3 comprise a plurality of first signal terminals 31, at least one power terminal 32, and at least one ground terminal 313. The first signal terminals 31 comprise a plurality of pairs of first signal terminals 311/313 and a pair of first low-speed signal terminals 312. From a front view of the first receptacle terminals 3, the first receptacle terminals 3 comprise, from left to right, a ground terminal 33 (Gnd), a first pair of first high-speed signal terminals 311 (TX1+−, differential signal terminals for high-speed signal transmission), a power terminal 32 (Power/VBUS), a first function detection terminal 341 (CC1, a terminal for inserting orientation detection of the connector and for cable recognition), a pair of first low-speed signal terminals 312 (D+−, differential signal terminals for low-speed signal transmission), a first supplement terminal 342 (SBU1, a terminal can be reserved for other purposes), another power terminal 32 (Power/VBUS), a second pair of first high-speed signal terminals 313 (RX2+−, differential signal terminals for high-speed signal transmission), and another ground terminal 33 (Gnd). In this embodiment, twelve first receptacle terminals 3 are provided for transmitting USB 3.0 signals. Each pair of the first high-speed signal terminals 311/313 is between the corresponding power terminal 32 and the adjacent ground terminal 33. The pair of the first low-speed signal terminals 312 is between the first function detection terminal 341 and the first supplement terminal 342.

Furthermore, in some embodiments, the rightmost ground terminal 33 (Gnd) (or the leftmost ground terminal 33 (Gnd)) or the first supplement terminal 342 (SBU1) can be further omitted. Therefore, the total number of the first receptacle terminals 3 can be reduced from twelve terminals to seven terminals. Furthermore, the ground terminal 33 (Gnd) may be replaced by a power terminal 32 (Power/VBUS) and provided for power transmission. In this embodiment, the width of the power terminal 32 (Power/VBUS) may be, but not limited to, equal to the width of the first signal terminal 31. In some embodiments, the width of the power terminal 32 (Power/VBUS) may be greater than the width of the first signal terminal 31 and an electrical receptacle connector 100 having the power terminal 32 (Power/VBUS) can be provided for large current transmission.

Please refer to FIGS. 1 to 4. In this embodiment, the first receptacle terminals 3 are on the first terminal base 111 and formed as the upper-row terminals of the electrical receptacle connector 100. Each of the first receptacle terminals 3 comprises a flat contact portion 35, a body portion 37, and a tail portion 36. For each of the first receptacle terminals 3, the body portion 37 is held in the first terminal base 111, the flat contact portion 35 extends forward from the body portion 37 in the rear-to-front direction and is partly exposed upon the first surface 12*a* of the tongue portion 12, and the tail portion 36 extends backward from the body portion 37 in the front-to-rear direction and protrudes from the rear of the first terminal base 111. The first signal terminals 31 are disposed on the first surface 12*a* and transmit first signals (i.e., USB 3.0 signals). The tail portions 36 extend from the body portions 37 and are bent horizontally to form flat legs, named legs manufactured by SMT (surface mount technology), which can be mounted or soldered on the surface of a printed circuit board (PCB) by using surface mount technology. In another embodiment, the tail portions 36 may extend from the body portions 37 downwardly to form vertical legs, named legs manufactured by through-hole technology, which can be inserted into holes drilled in a printed circuit board (PCB).

Please refer to FIGS. 1 to 4. In this embodiment, the second receptacle terminals 4 comprise a plurality of second signal terminals 41, at least one power terminal 42, and at least one ground terminal 43. The second signal terminals 41 comprise a plurality of pairs of second signal terminals 411/413 and a pair of second low-speed signal terminal 412. From a front view of the second receptacle terminals 4, the second receptacle terminals 4 comprise, from right to left, a ground terminal 43 (Gnd), a first pair of second high-speed signal terminals 411 (TX2+−, differential signal terminals for high-speed signal transmission), a power terminal 42 (Power/VBUS), a second function detection terminal 441 (CC2, a terminal for inserting orientation detection of the connector and for cable recognition), a pair of second low-speed signal terminals 412 (D+−, differential signal terminals for low-speed signal transmission), a second supplement terminal 442 (SBU2, a terminal can be reserved for other purposes), another power terminals 42 (Power/VBUS), a second pair of second high-speed signal terminals 413 (RX1+−, differential signal terminals for high-speed signal transmission), and another ground terminal 43 (Gnd). In this embodiment, twelve second receptacle terminals 4 are provided for transmitting USB 3.0 signals. Each pair of the second high-speed signal terminals 411/413 is between the corresponding power terminal 42 and the adjacent ground terminal 43. The pair of the second low-speed signal terminals 412 is between the second function detection terminal 441 and the second supplement terminal 442.

Furthermore, in some embodiments, the rightmost ground terminal 43 (or the leftmost ground terminal 43) or the second supplement terminal 442 (SBU2) can be further omitted. Therefore, the total number of the second receptacle terminals 4 can be reduced from twelve terminals to seven terminals. Furthermore, the rightmost ground terminal 43 (Gnd) may be replaced by a power terminal 42 and provided for power transmission. In this embodiment, the width of the power terminal 42 (Power/VBUS) may be, but not limited to, equal to the width of the second signal terminal 41. In some embodiments, the width of the power terminal 42 (Power/VBUS) may be greater than the width of the second signal terminal 41 and an electrical receptacle connector 100 having the power terminal 42 (Power/VBUS) can be provided for large current transmission.

Please refer to FIGS. 1 to 4. The second receptacle terminals 4 are held in the second terminal base 112 and formed as the lower-row terminals of the electrical receptacle connector 100. The first receptacle terminals 3 are substantially aligned parallel with the second receptacle terminals 4. In this embodiment, each of the second receptacle terminals 4 comprises a flat contact portion 45, a body portion 47, and a tail portion 46. For each of the second receptacle terminals 4, the body portion 47 is held in the second terminal base 112 and the tongue portion 12, the flat contact portion 45 extends from the body portion 47 in the rear-to-front direction and is partly exposed upon the second surface 12*b* of the tongue portion 12, and the tail portion 416 extends backward from the body portion 47 in the front-to-rear direction and protrudes from the rear of the second terminal base 112. The second signal terminals 4 are disposed at the second surface 12*b* and transmit second signals (i.e., USB 3.0 signals). In addition, the tail portions 46 extend from the body portions 47 and bent horizontally to form flat legs, named legs manufactured by SMT (surface mount technology), which can be base portioned or soldered on the surface of a printed circuit board (PCB) by using surface mount technology. In another embodiment, the tail portions 46 may extend downwardly to form vertical legs, named legs manufactured by through-hole technology, which can be inserted into holes drilled in a printed circuit board (PCB). The tail portions 36 and the tail portions 46 are arranged in a staggered manner from the top view.

Please refer to FIGS. 1 to 4. In this embodiment, the first receptacle terminals 3 and the second receptacle terminals 4 are disposed upon the first surface 12*a* and the second surface 12*b* of the tongue portion 12, respectively, and pin-assignments of the first receptacle terminals 3 and the second receptacle terminals 4 are point-symmetrical with a central point of a receptacle cavity 54 of the metallic shell 5 as the symmetrical center. In other words, pin-assignments of the first receptacle terminals 3 and the second receptacle terminals 4 have 180-degree symmetrical design with respect to the central point of the receptacle cavity 54 as the symmetrical center. The dual or double orientation design enables an electrical plug connector to be inserted into the electrical receptacle connector 100 in either of two intuitive orientations, i.e., in either upside-up or upside-down directions. Here, point-symmetry means that after the first receptacle terminals 3 (or the second receptacle terminals 4), are rotated by 180 degrees with the symmetrical center as the rotating center, the first receptacle terminals 3 and the second receptacle terminals 4 are overlapped. That is, the rotated first receptacle terminals 3 are arranged at the position of the original second receptacle terminals 4, and the rotated second receptacle terminals 4 are arranged at the position of the original first receptacle terminals 3. In other words, the first receptacle terminals 3 and the second receptacle terminals 4 are arranged upside down, and the pin assignments of the flat contact portions 35 are left-right reversal with respect to that of the flat contact portions 45. An electrical plug connector is inserted into the electrical receptacle connector 100 with a first orientation where the first surface 12*a* is facing up, for transmitting first signals. Conversely, the electrical plug connector is inserted into the electrical receptacle connector 100 with a second orientation where the first surface 12*a* is facing down, for transmitting second signals. Furthermore, the specification for transmitting the first signals is conformed to the specification for transmitting the second signals. Note that, the inserting orientation of the electrical plug connector is not limited by the electrical receptacle connector 100 according embodiments of the instant disclosure.

Additionally, in some embodiments, the electrical receptacle connector 100 is devoid of the first receptacle terminals 3 (or the second receptacle terminals 4) when an electrical plug connector to be mated with the electrical receptacle connector 100 has upper and lower plug terminals. In the case that the first receptacle terminals 3 are omitted, the upper plug terminals or the lower plug terminals of the electrical plug connector are in contact with the second receptacle terminals 4 of the electrical receptacle connector 100 when the electrical plug connector is inserted into the electrical receptacle connector 100 with the dual orientations. Conversely, in the case that the second receptacle terminals 4 are omitted, the upper plug terminals or the lower plug terminals of the electrical plug connector are in contact with the first receptacle terminals 3 of the electrical receptacle connector 100 when the electrical plug connector is inserted into the electrical receptacle connector 100 with the dual orientations.

Please refer to FIGS. 1 to 4. In this embodiment, as viewed from the front of the receptacle terminals 3, 4, the position of the first receptacle terminals 3 corresponds to the position of the second receptacle terminals 4. In other words, the positions of the flat contact portions 35 are respectively aligned with the positions of the flat contact portions 45, but embodiments are not limited thereto. In some embodiments, the first receptacle terminals 3 may be aligned by an offset with respect to the second receptacle terminals 4. That is, the flat contact portions 35 are aligned by an offset with respect to the flat contact portions 45. Accordingly, because of the offset alignment of the flat contact portions 35, 45, the crosstalk between the first receptacle terminals 3 and the second receptacle terminals 4 can be reduced during signal transmission. It is understood that, when the receptacle terminals 3, 4 of the electrical receptacle connector 100 have the offset alignment, plug terminals of an electrical plug connector to be mated with the electrical receptacle connector 100 would also have the offset alignment. Hence, the plug terminals of the electrical plug connector can be in contact with the receptacle terminals 3, 4 of the electrical receptacle connector 100 for power or signal transmission.

In the foregoing embodiments, the receptacle terminals 3, 4 are provided for transmitting USB 3.0 signals, but embodiments are not limited thereto. In some embodiments, for the first receptacle terminals 3 in accordance with transmission of USB 2.0 signals, the first pair of the first high-speed signal terminals 311 (TX1+−) and the second pair of the first high-speed signal terminals 313 (RX2+−) are omitted, and the pair of the first low-speed signal terminals 312 (D+−) and the power terminals 32 (Power/VBUS) are retained. While for the second receptacle terminals 4 in accordance with transmission of USB 2.0 signals, the first pair of the second high-speed signal terminals 411 (TX2+−) and the second pair of the second high-speed signal terminals 413 (RX1+−) are omitted, and the pair of the second low-speed signal terminals 412 (D+−) and the power terminals 42 (Power/VBUS) are retained.

Please refer to FIGS. 1 to 4. In this embodiment, the metallic shell 5 is a hollowed shell. The metallic shell 5 comprises two side plates 5*a*, a top plate 5*b*, and a bottom plate 5*c*. The two side plates 5*a* receptively locate adjacent to two sides of the tongue portion 12. The top plate 5*b* locates adjacent to one of two surfaces of the tongue portion 12 (i.e., the first surface 12*a*). The bottom plate 5*c* locates adjacent to the other surface of the tongue portion 12 (i.e., the second surface 12*b*). The two side plates 5*a*, the top plate 5*b*, and the bottom plate 5*c* are connected with each other to form an insertion opening 52 of the metallic shell 5, and the insertion opening 52 is near a front end 12*d* of the tongue portion 12.

Please refer to FIGS. 1 to 4. In this embodiment, at least one first leg 56 extends outwardly from each of the side plates 5*a* of the metallic shell 5. The first legs 56 are formed as vertical legs, named legs manufactured by through-hole technology. Specifically, in this embodiment, a rear cover 58 extends from a rear portion of the metallic shell 5, a plurality of first legs 56 extends outwardly from the rear cover 58, and the first legs 56 on the two side plates 5*a* and the first legs 56 on the rear cover 58 are substantially aligned perpendicular with each other. Each of the first legs 56 (i.e., each of the first legs 56 on the side plate 5*a* and each of the first legs 56 on the rear cover 58) comprises a first main body 561. The first main body 561 has an increased width. Therefore, when the first main body 561 is soldered on the circuit board 9, the fixation of the electrical receptacle connector 100 on the circuit board 9 can be improved.

Figure 5:
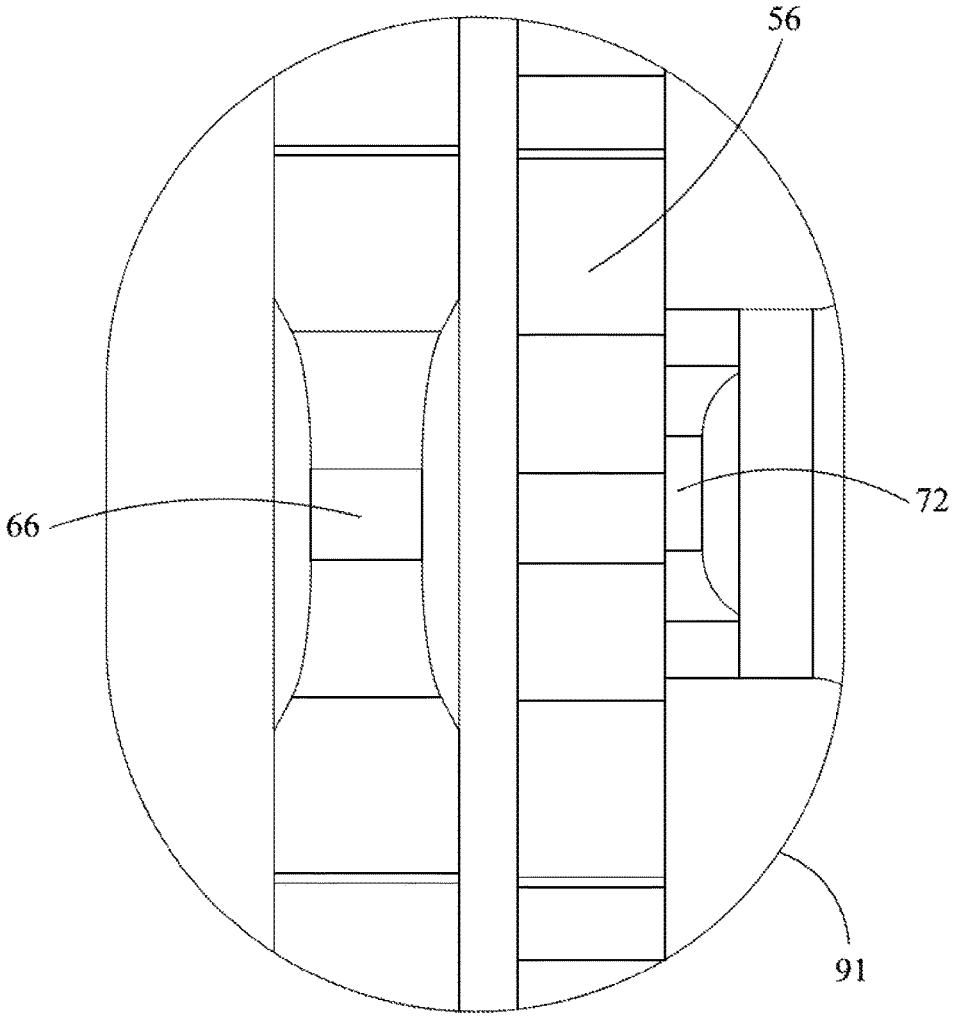
FIG. 5 illustrates a schematic top view showing that a first leg, a second leg, and a shielding leg are in a hole of the circuit board.
Figure 6:
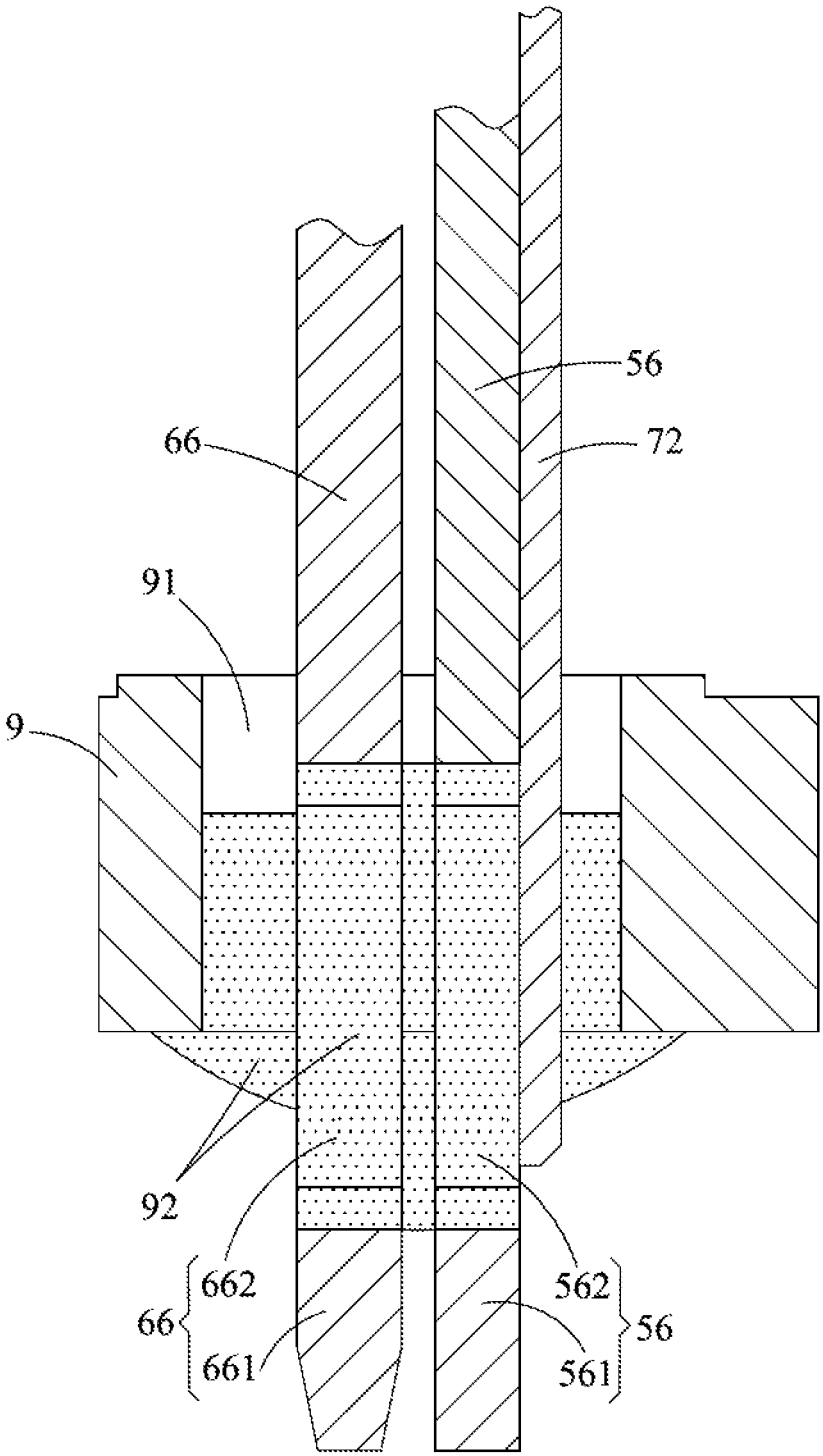
FIG. 6 illustrates a schematic lateral sectional view showing that the first leg, the second leg, and the shielding leg are in the hole of the circuit board.
Figure 7:
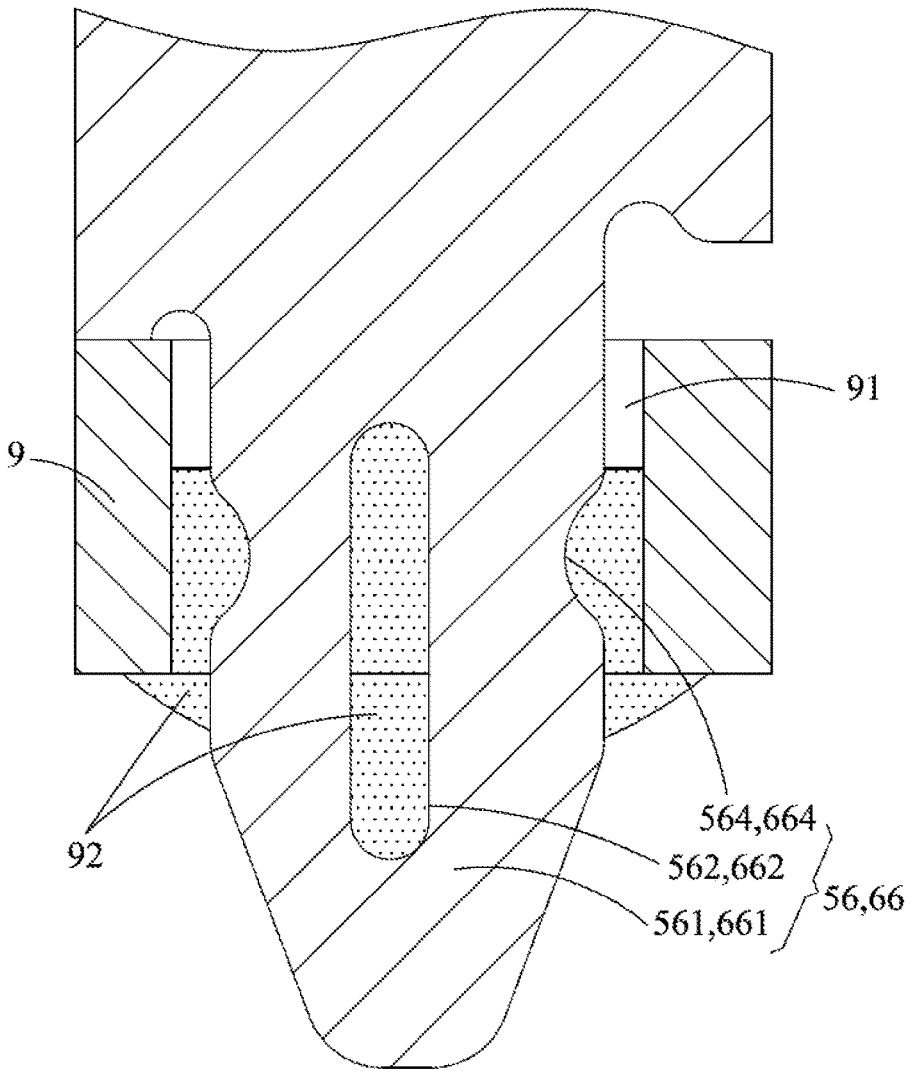
FIG. 7 illustrates a schematic lateral sectional view showing that the first leg and the second leg are in the hole of the circuit board.

Please refer to FIGS. 2, 5, 6, and 7. FIG. 5 illustrates a schematic top view showing that a first leg, a second leg, and a shielding leg are in a hole of the circuit board. FIG. 6 illustrates a schematic lateral sectional view showing that the first leg, the second leg, and the shielding legs are in the hole of the circuit board. FIG. 7 illustrates a schematic view lateral sectional view showing that the first leg and the second leg are in the hole of the circuit board. In this embodiment, each of the first legs 56 on the side plate 5*a* comprises a first slot 562 formed on the first main body 561. The first slot 562 is defined through the first main body 561, from one of two opposite surfaces to the other surface. The first slot 562 is a closed space. The first slot 562 is a rectangular hole, and the length direction of the first slot 562 extends from an exterior of the hole 91 of the circuit board 9 toward an interior of the hole 91 of the circuit board 9. Accordingly, when the electrical receptacle connector 100 is soldered on the circuit board 9 (as shown in FIG. 1), the solder 92 is applied to the surface of the circuit board 9 and flows into the first slot 562. The space for receiving the solder 92 is increased by the first slot 562, and the solder 92 is attached onto an inner surface of the first slot 562. Therefore, the area of the connector attached with the solder 92 can be increased and the fixation of the electrical receptacle connector 100 on the circuit board 9 can be improved. In addition, the first slot 562 prevents the solder 92 at one of two ends of the hole 91 from entering into the other end of the hole 91. In other words, the first slot 562 prevents solder wicking. In another embodiment, a first leg of the metallic shell is in contact with a second leg of the outer shell, a shielding leg of the shielding plate is in contact with the first leg of the metallic shell, and the first leg, the second leg, and the shielding leg are inserted into a hole of the circuit board.

Please refer to FIGS. 2, 5, 6, and 7. In this embodiment, each of the first legs 56 comprises first recessed portions 564, and the first recessed portions 564 are at two sides of the first main body 561. Accordingly, when the electrical receptacle connector 100 is soldered on the circuit board 9 (as shown in FIG. 1), the solder 92 is applied to the surface of the circuit board 9 and flows into the first recessed portions 564. The space for receiving the solder 92 is increased by the first recessed portion 564, and the solder 92 is attached onto an inner surface of the first recessed portion 564. Therefore, the area of the connector attached with the solder 92 can be increased and the fixation of the electrical receptacle connector 100 on the circuit board 9 can be improved. In addition, the first recessed portion 564 prevents the solder 92 at one of two ends of the hole 91 from entering into the other end of the hole 91. In other words, the first recessed portion 564 prevents solder wicking. Furthermore, the first main body 561 further includes a first bottom wall 5611 and two first slit side walls 5613. The two first slit side walls 5613 are at two opposite sides of the first main body 561, respectively. Each of two first slit side walls 5613 are extended from one end of first recessed portion 564 and connected to one side of the first bottom wall 5611, such that the width of first main body 561 is gradually reduced from the first recessed portion 564 to the first bottom wall 5611.

Please refer to FIG. 1. In this embodiment, the metallic shell 5 comprises a front region 51*a* and a rear region 51*b*. The front region 51*a* is near the insertion opening 52. The rear region 51*b* is defined at the bottom plate 5*c* and located at a rear portion of the front region 51*a*. The surface of the circuit board 9 is assembled on the rear region 51*b* of the metallic shell 5, and the edge 9*a* of the circuit board 9 is near the edge portion 6*d* of the outer shell 6. Therefore, the edge 9*a* of the circuit board 9 can be leaned against the edge portion 6*d* of the outer shell 6 to improve the fixation between the connector and the circuit board 9.

Please refer to FIGS. 1 and 2. In this embodiment, the metallic shell 5 comprises a receptacle cavity 54, and the receptacle cavity 54 communicates with the insertion opening 52. In addition, the terminal module 1 is assembled in the receptacle cavity 54. In this embodiment, the metallic shell 5 is a tubular member.

Please refer to FIGS. 1 and 2. In this embodiment, the outer shell 6 is out of the metallic shell 5. The outer shell 6 encloses a portion of the metallic shell 5 which is near the insertion opening 52 of the metallic shell 5. The outer shell 6 is a tubular member and encloses the metallic shell 5, and the outer shell 6 is positioned with the metallic shell 5 by laser welding. In other words, the outer shell 6 comprises a top portion 6*b*, a bottom portion 6*c*, and two side portions 6*a* each connected to the top portion 6*b* and the bottom portion 6*c*. From a front view of the outer shell 6, the top portion 6*b*, the bottom portion 6*c*, and the two side portions 6*a* have a rectangular-loop shape, and the top portion 6*b*, the bottom portion 6*c*, and the two side portions 6*a* form a receiving space for receiving the metallic shell 5. Please refer to FIGS. 1 and 2. In this embodiment, the outer shell 6 stacks on the two side plates 5*a*, the top plate 5*b*, and the bottom plate 5*c* of the metallic shell 5 to form a double-layer shell structure. In other words, the outer shell 6 encloses the front region 51*a* at the insertion opening 52. In addition, the periphery of the outer shell 6 is aligned with the periphery of the insertion opening 52, and the outer shell 6 encloses the entire surface of the front region 51*a* of the metallic shell 5, and the enclosed length of the outer shell 6 is one-third of the length of the entire connector. Accordingly, the structural strength around the insertion opening 52 of the metallic shell 5 can be improved. The electrical receptacle connector 100 can have a double-layer shell structure formed by the metallic shell 5 and the outer shell 6. Therefore, the structural strength of the metallic shell 5 around the insertion opening 52 can be improved. Hence, when an electrical plug connector is inserted into the insertion opening 52 of the metallic shell 5 of the electrical receptacle connector 100, the metallic shell 5 does not deform or bend easily.

Please refer to FIGS. 1 and 2. In this embodiment, the outer shell 6 further comprises a plurality of sidewalls 63 and a plurality of second legs 66. The sidewalls 63 respectively extend from the two side portions 6*a* toward two sides of the rear region 51*b*, and the second legs 66 respectively extend outwardly from edges of the sidewalls 63. The second legs 66 are formed as vertical legs, named legs manufactured by through-hole technology. In this embodiment, each of the sidewalls 63 has two second legs 66 aligned in a front-to-rear direction of the outer shell 6, the two second legs 66 at the front portions of the two sidewalls 63 correspond to each other, and the two second legs 66 at the rear portions of the two sidewalls 63 correspond to each other. In other words, the two second legs 66 at the front portions of the two sidewalls 63 are aligned in a horizontal line, and the two second legs 66 at the rear portions of the two sidewalls 63 are aligned in a horizontal line and near the two sides of the base portion 11. In addition, the two second legs 66 at the rear portions of the two sidewalls 63 respectively correspond to adjacent two first legs 56 at two sides of the metallic shell 5. That is, each of the second legs 66 at the rear portions of the two sidewalls 63 is near an outer side of the corresponding first leg 56 and aligned with the corresponding first leg 56.

Figure 8:
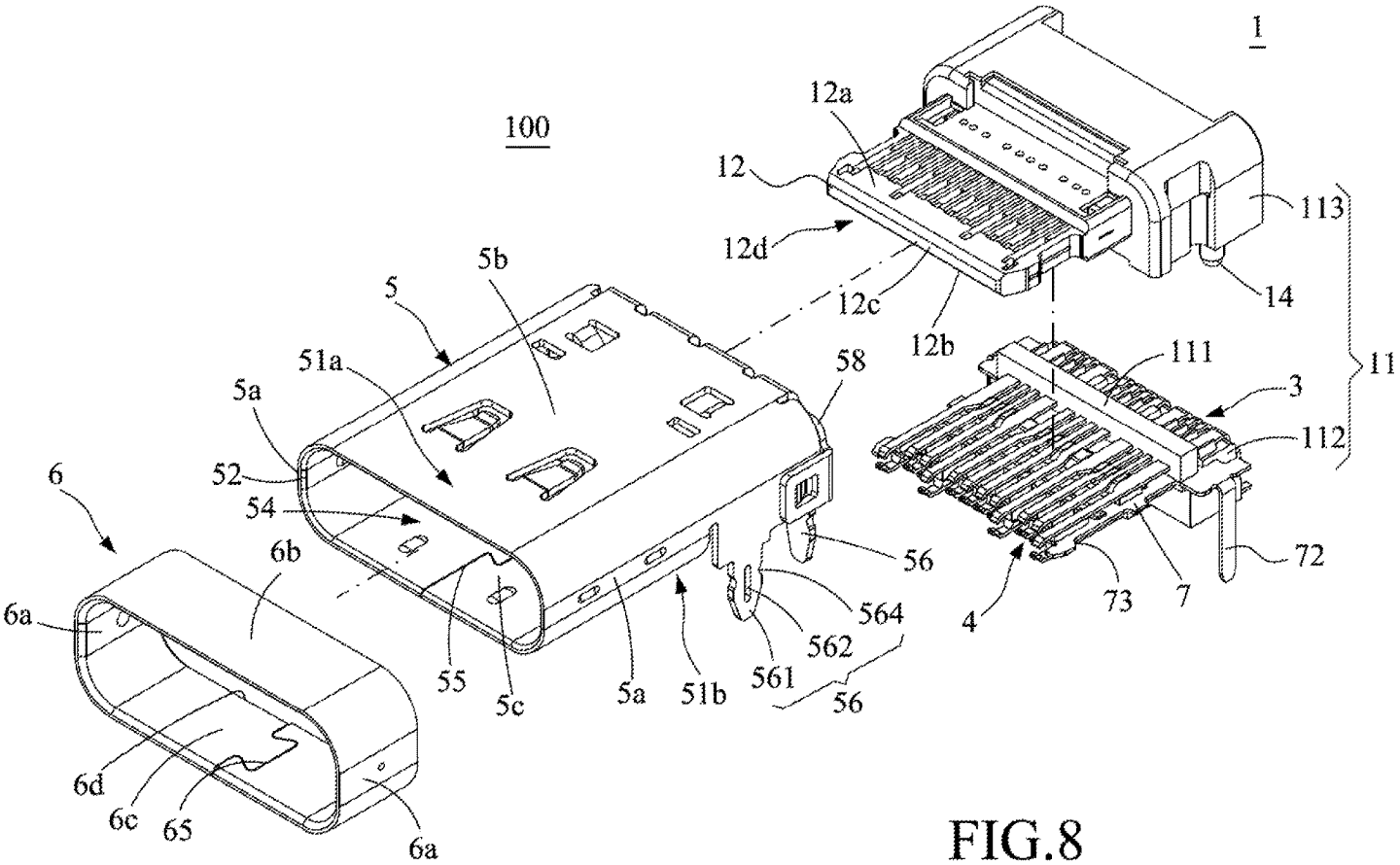
FIG. 8 illustrates an exploded view of one embodiment of the outer shell.
Figure 9:
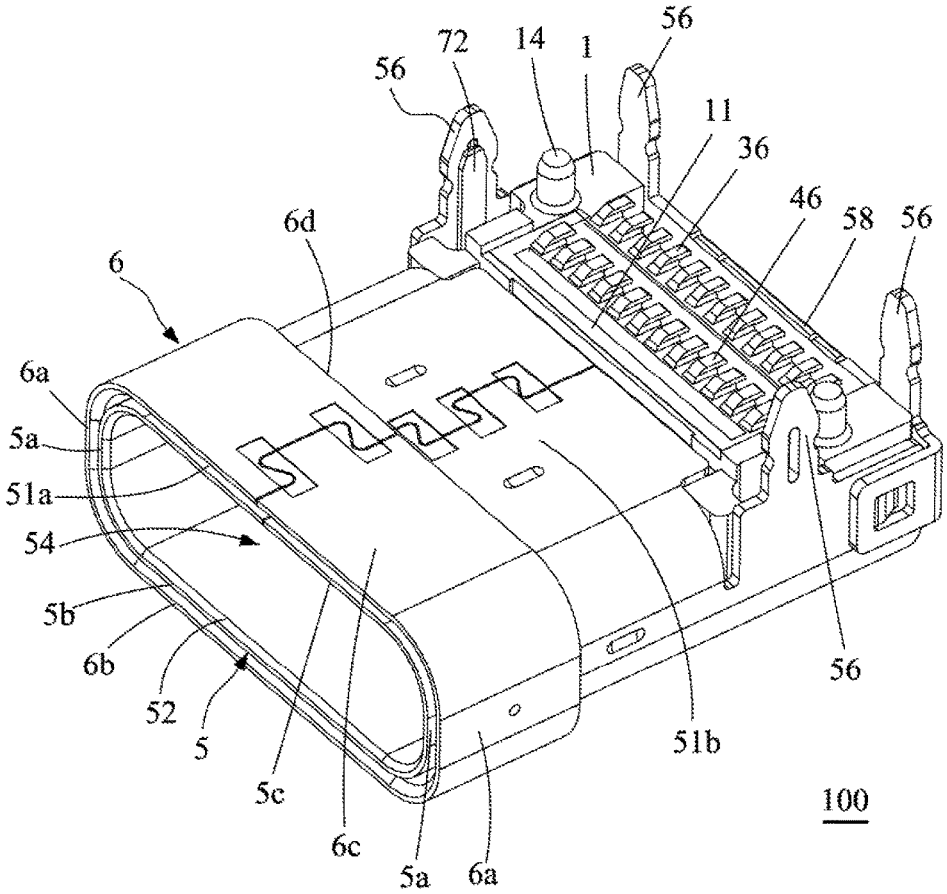
FIG. 9 illustrates a perspective view of one embodiment of the outer shell.
Figure 10:
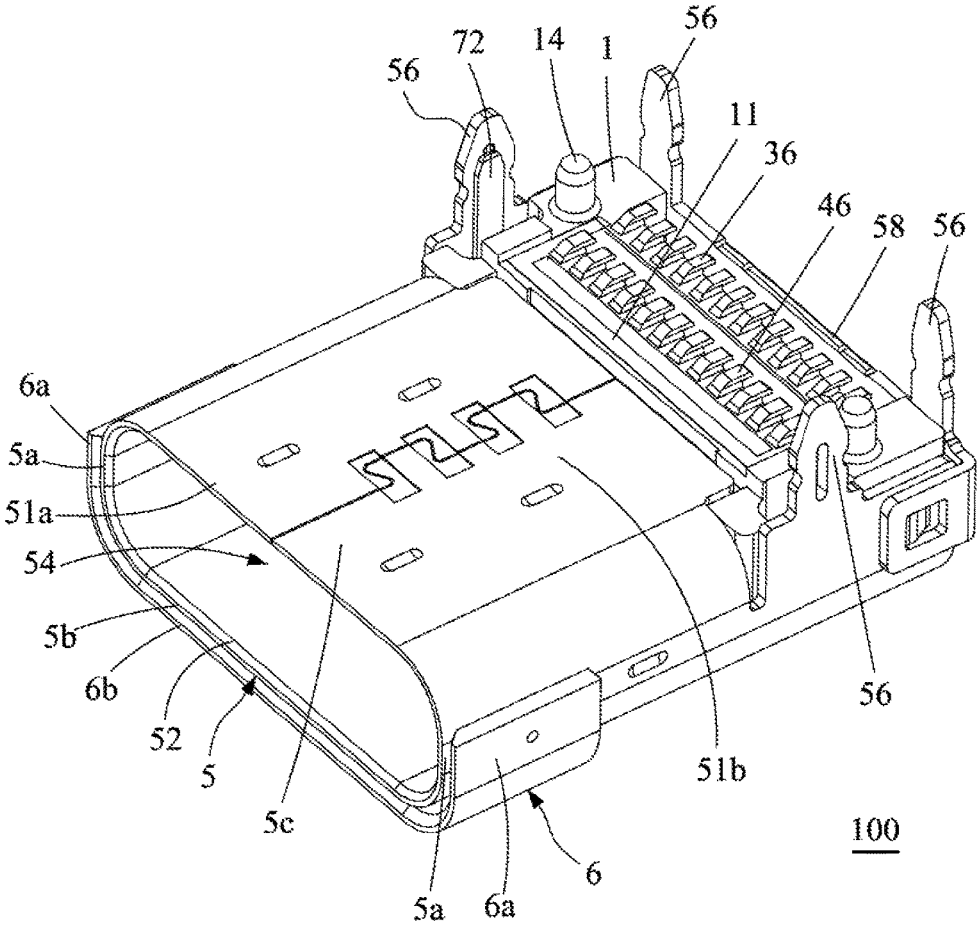
FIG. 10 illustrates a perspective view of another embodiment of the outer shell.

Please refer to FIGS. 8 and 9. In one embodiment, the outer shell 6 encloses the insertion opening 52 of the metallic shell 5 and is devoid of the sidewalls 63 and the second legs 66. In other words, the outer shell 6 is a simple tubular member, but embodiments are not limited thereto. In one embodiment, as shown in FIG. 10, the outer shell 6 comprises a top portion 6*b* and two side portions 6*a* respectively extended from two sides of the top portion 6*b*. From a front view of the outer shell 6, the top portion 6*b* and the two side portions 6*a* have a reverse U shape, and the top portion 6*b* and the two side portions 6*a* form an assembling space for stacking on the metallic shell 5.

Please refer to FIGS. 2, 5, 6, and 7. In this embodiment, each of the second legs 66 comprises a second main body 661 and a second slot 662 formed on the second main body 661. The second slot 662 is defined through the second main body 661, from one of two opposite surfaces to the other surface. The second slot 662 is a closed space. The second slot 662 is a rectangular hole, and the length direction of the second slot 662 extends from an exterior of the hole 91 of the circuit board 9 toward an interior of the hole 91 of the circuit board 9. Accordingly, when the electrical receptacle connector 100 is soldered on the circuit board 9 (as shown in FIG. 1), the solder 92 is applied to the surface of the circuit board 9 and flows into the second slot 662. The space for receiving the solder 92 is increased by the second slot 662, and the solder 92 is attached onto an inner surface of the second slot 662. Therefore, the area of the connector attached with the solder 92 can be increased and the fixation of the electrical receptacle connector 100 on the circuit board 9 can be improved. In addition, the second slot 662 prevents the solder 92 at one of two ends of the hole 91 from entering into the other end of the hole 91. In other words, the second slot 662 prevents solder wicking.

Please refer to FIGS. 2, 5, 6, and 7. In this embodiment, each of the second legs 66 comprises second recessed portions 664, and the second recessed portions 664 are at two sides of the second main body 661. Accordingly, when the electrical receptacle connector 100 is soldered on the circuit board 9 (as shown in FIG. 1), the solder 92 is applied to the surface of the circuit board 9 and flows into the second recessed portions 664. The space for receiving the solder 92 is increased by the second recessed portion 664, and the solder 92 is attached onto an inner surface of the second recessed portion 664. Therefore, the area of the connector attached with the solder 92 can be increased and the fixation of the electrical receptacle connector 100 on the circuit board 9 can be improved. In addition, the second recessed portion 664 prevents the solder 92 at one of two ends of the hole 91 from entering into the other end of the hole 91. In other words, the second recessed portion 664 prevents solder wicking. Furthermore, the second main body 661 further includes a second bottom wall 6611 and two second slit side walls 6613. The two second slit side walls 6613 are at two opposite sides of the second main body 661, respectively. Each of two second slit side walls 6613 are extended from one end of second recessed portion 664 and connected to one side of the second bottom wall 6611, such that the width of second main body 661 is gradually reduced from the second recessed portion 664 to the second bottom wall 6611.

Please refer to FIG. 2. In this embodiment, the metallic shell 5 and the outer shell 6 are respectively tubular members formed by bending a board. A cocktail-shaped slit 55 may be, but not limited to, formed on the tubular member of the metallic shell 5; that is, for the metallic shell 5, the cocktail-shaped slit 55 is formed between peripheries of two connected ends of the board. Similarly, a cocktail-shaped slit 65 may be, but not limited to, formed on the tubular member of the outer shell 6; that is, for the outer shell 6, the cocktail-shaped slit 65 is formed between peripheries of two connected ends of the board. In some embodiments, the metallic shell 5 and the outer shell 6 may be unitary members, respectively. Furthermore, the metallic shell 5 and the outer shell 6 may be formed by deep drawing technique, so that the metallic shell 5 and the outer shell 6 do not have the cocktail-shaped slit.

Please refer to FIGS. 2 to 4. The shielding plate 7 is in the base portion 11 and the tongue portion 12. The shielding plate 7 comprises a plate body 71 and a plurality of shielding legs 72. The plate body 71 is between the flat contact portions 35 of the first receptacle terminals 3 and the flat contact portions 45 of the second receptacle terminals 4. Specifically, the plate body 71 may be lengthened and widened, so that the front end of the plate body 71 is near the front lateral surface 12*c* of the tongue portion 12. Two sides of the plate body 71 protrude from two sides of the tongue portion 12 for being in contact with an electrical plug connector, and the rear end of the plate body 71 is near the rear portion of the second terminal base 112. Accordingly, the plate body 71 can be disposed on the tongue portion 12 and the second terminal base 112, and the structural strength of the tongue portion 12 and the shielding performance of the tongue portion 12 can be improved.

Please refer to FIGS. 2 to 4. The shielding legs 72 of the shielding plate 7 extend downward from two sides of the rear portion of the shielding plate 7 to form vertical legs. That is, the shielding legs 72 are exposed from the second terminal base 112 and in contact with the circuit board 9. In this embodiment, the crosstalk interference can be reduced by the shielding of the shielding plate 7 when the flat contact portions 35, 45 transmit signals. Furthermore, the structural strength of the tongue portion 12 can be improved by the assembly of the shielding plate 7. In addition, the shielding legs 72 of the shielding plate 7 are exposed from the second terminal base 112 and in contact with the circuit board for conduction and grounding.

Please refer to FIGS. 1 to 3 and FIG. 5. It is understood that, each of the shielding legs 72 of the shielding plate 7 is near the inner side of the corresponding first leg 56 and aligned with the corresponding first leg 56, and the corresponding second leg 66 is near the outer side of the corresponding first leg 56 and aligned with the corresponding first leg 56. Therefore, the three legs are arranged adjacently and aligned with each other. Accordingly, the shielding leg 72 of the shielding plate 7, the first leg 56 of the metallic shell 5, and the second leg 66 of the outer shell 6 can be inserted into the same hole 91 of the circuit board 9. Thus, the solder 92 can be attached onto the shielding leg 72, the first leg 56, and the second leg 66. Consequently, the fixation between the connector and the circuit board 9 can be improved and the cost for fabricating the holes 91 of the circuit board 9 can be reduced.

Please refer to FIGS. 2 to 4. The shielding plate 7 further comprises a plurality of hooks 73. The hooks 73 extend outwardly from two sides of a front portion of the plate body 71, and the hooks 73 protrude from the front lateral surface 12*c* and two sides of the tongue portion 12. When an electrical plug connector is mated with the electrical receptacle connector 100, elastic pieces at two sides of an insulated housing of the electrical plug connector are engaged with the hooks 73, and the elastic pieces would not wear against the tongue portion 12 of the electrical receptacle connector 100. Hence, the shielding plate 7 can be in contact with the metallic shell of the plug connector for conduction and grounding.

As above, the first slot is formed on each of the first legs on the corresponding side of the metallic shell, and the first slot increases the space for receiving the solders to prevent solder wicking. Moreover, the outer shell is out of the metallic shell and near the insertion opening, and the outer shell stacks on the metallic shell. Therefore, the electrical receptacle connector can have a double-layer shell structure formed by the metallic shell and the outer shell. Accordingly, the structural strength of the metallic shell around the insertion opening can be improved. Hence, when an electrical plug connector is inserted into the insertion opening of the metallic shell, the metallic shell does not deform or bend easily. Moreover, one shielding leg, one first leg, and one second leg are inserted into the same hole of the circuit board. Thus, the fixation between the connector and the circuit board can be improved and the cost for fabricating the holes of the circuit board can be reduced. Furthermore, the first slot and the first recessed portions of the first leg allow the first leg to have more spaces to receive the solder to prevent solder wicking. Similarly, the second slot and the second recessed portions of the second leg allow the second leg to have more spaces to receive the solder to prevent solder wicking.

Furthermore, the first receptacle terminals and the second receptacle terminals are arranged upside down, and the pin-assignment of the flat contact portions of the first receptacle terminals is left-right reversal with respect to that of the flat contact portions of the second receptacle terminals. Accordingly, the electrical receptacle connector can have a 180-degree symmetrical, dual or double orientation design and pin assignments which enables the electrical receptacle connector to be mated with a corresponding plug connector in either of two intuitive orientations, i.e. in either upside-up or upside-down directions. Therefore, when an electrical plug connector is inserted into the electrical receptacle connector with a first orientation, the flat contact portions of the first receptacle terminals are in contact with upper-row plug terminals of the electrical plug connector. Conversely, when the electrical plug connector is inserted into the electrical receptacle connector with a second orientation, the flat contact portions of the second receptacle terminals are in contact with the upper-row plug terminals of the electrical plug connector. Note that, the inserting orientation of the electrical plug connector is not limited by the electrical receptacle connector of the instant disclosure.

While the instant disclosure has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. An electrical receptacle connector, comprising:

a terminal module comprising a base portion, a tongue portion extended outwardly from the base portion, and a plurality of receptacle terminals held in the base portion, wherein one of two ends of each of the receptacle terminals extends toward the tongue portion, and the other end of each of the receptacle terminals protrudes out of the base portion, wherein the receptacle terminals comprise a plurality of first receptacle terminals and a plurality of second receptacle terminals, the first receptacle terminals and the second receptacle terminals are held in the base portion and the tongue portion, first flat contact portions of the first receptacle terminals at one ends of the first receptacle terminals are at the first surface of the tongue portion, and second flat contact portions of the second receptacle terminals at one ends of the second receptacle terminals are at the second surface of the tongue portion;

a metallic shell receiving the terminal module, wherein each of two sides of the metallic shell extends outwardly at least one first leg, and each of the first legs forms a first slot, wherein each of the first legs comprises a first main body and the first slot is defined through the first main body from two opposite surfaces to the other surface, and the first slot is a closed space; and a shielding plate held inside the base portion and the tongue portion, wherein the shielding plate comprises a plate body and at least one shielding leg, the plate body is between the first flat contact portions and the second flat contact portions, the at least one shielding leg extends outwardly from one of two sides of the plate body, the at least one shielding leg is near an inner side of the corresponding first leg and aligned with the corresponding first leg.

2. The electrical receptacle connector according to claim 1, wherein the metallic shell comprises a plurality of side plates, a top plate, and a bottom plate, the side plates respectively locate adjacent to two sides of the tongue portion, the top plate locates adjacent to a first surface of the tongue portion, and the bottom plate locates adjacent to a second surface of the tongue portion opposite to the first surface, the side plates, the top plate, and the bottom plate are connected with each other to form an insertion opening of the metallic shell and the insertion opening is near a front end of the tongue portion.

3. The electrical receptacle connector according to claim 2, further comprising an outer shell out of the metallic shell and near the insertion opening, wherein the outer shell stacks on the metallic shell to form a double-layer shell structure.

4. The electrical receptacle connector according to claim 3, wherein the metallic shell comprises a front region and a rear region defined at the bottom plate and located at a rear portion of the front region.

5. The electrical receptacle connector according to claim 4, wherein the outer shell comprises a plurality of sidewalls and a plurality of second legs, the sidewalls respectively extend toward two sides of the rear region, and the second legs respectively extend outwardly from edges of the sidewalls.

6. The electrical receptacle connector according to claim 5, wherein one of the second legs on each of the sidewalls is near an outer side of the corresponding first leg and aligned with the corresponding first leg.

7. The electrical receptacle connector according to claim 5, wherein each of the second legs comprises a second main body and a second slot formed on the second main body.

8. The electrical receptacle connector according to claim 7, wherein each of the second legs comprises a plurality of second recessed portions, and the second recessed portions are formed at two sides of the second main body.

9. The electrical receptacle connector according to claim 8, wherein the second main body further comprises a second bottom wall and two second slit side walls, the two second slit side walls are at two opposite sides of the second main body, respectively, each of two second slit side walls are extended from one end of second recessed portion and connected to one side of the second bottom wall, such that a width of second main body is gradually reduced from the second recessed portion to the second bottom wall.

10. The electrical receptacle connector according to claim 5, wherein the second legs at front portions of the sidewalls are aligned along a first horizontal line, the second legs at rear portions of the sidewalls are aligned along a second horizontal line and near the two sides of the base portion.

11. The electrical receptacle connector according to claim 3, wherein the outer shell comprises a top portion, a bottom portion, and two side portions each connected to the top portion and the bottom portion, the top portion, the bottom portion, and the two side portions form a receiving space for receiving the metallic shell.

12. The electrical receptacle connector according to claim 3, wherein the outer shell comprises a top portion and two side portions respectively extended from two sides of the top portion, the top portion and the two side portions form an assembling space for stacking on the metallic shell.

13. The electrical receptacle connector according to claim 1, wherein the base portion comprises a plurality of positioning posts, each of the positioning posts is near the corresponding first leg.

14. The electrical receptacle connector according to claim 1, wherein a rear cover and a plurality of first legs extend from a rear portion of the metallic shell, the first legs extend outwardly from two sides of the rear cover.

15. The electrical receptacle connector according to claim 1, wherein each of the first legs further comprises a plurality of first recessed portions, the first recessed portions are formed at two sides of the first main body, the first main body comprises a first bottom wall and two first slit side walls, the two first slit side walls are at two opposite sides of the first main body, respectively, each of two first slit side walls are extended from one end of first recessed portion and connected to one side of the first bottom wall, and a width of first main body is gradually reduced from the first recessed portion to the first bottom wall.

* * * * *